United States Patent [19]

Johnson

[11] 4,364,603

[45] Dec. 21, 1982

[54] RECLINING CHAIR

[75] Inventor: Carl B. Johnson, Pontiac, Ill.

[73] Assignee: Pontiac Furniture, Inc., Pontiac, Ill.

[21] Appl. No.: 90,631

[22] Filed: Nov. 2, 1979

[51] Int. Cl.[3] ..... A47C 1/02

[52] U.S. Cl. ..... 297/84; 297/68; 297/317

[58] Field of Search ..... 297/61, 68, 83, 84, 297/85, 86, 90, 91, 317, 326; 248/370

[56] References Cited

U.S. PATENT DOCUMENTS

| | | | |
|---|---|---|---|
| 361,804 | 4/1887 | Babka . | |
| 1,792,247 | 2/1931 | Schauss . | |
| 1,896,048 | 1/1933 | Grinnell . | |
| 2,015,138 | 9/1935 | Drake . | |
| 2,302,387 | 11/1942 | Greno et al. | 248/370 |
| 2,473,895 | 6/1949 | Mednick . | |
| 2,615,499 | 10/1952 | Wallace . | |
| 2,888,977 | 6/1959 | Thaden | 297/68 |
| 3,179,466 | 4/1965 | Garrett | 297/61 X |
| 3,191,990 | 6/1965 | Rugg et al. | 297/83 |
| 3,856,346 | 12/1974 | Herman | 297/61 |
| 3,880,462 | 4/1975 | Mednick | 297/84 |

FOREIGN PATENT DOCUMENTS

| | | | |
|---|---|---|---|
| 701781 | 1/1941 | Fed. Rep. of Germany | 297/61 |
| 1010702 | 1/1957 | Fed. Rep. of Germany | 297/84 |
| 603980 | 6/1948 | United Kingdom | 297/326 |
| 775679 | 5/1957 | United Kingdom | 297/84 |

*Primary Examiner*—James T. McCall

*Attorney, Agent, or Firm*—Fitch, Even, Tabin, Flannery & Welsh

[57] ABSTRACT

A reclining chair in which the backrest and seat are reclined, and the retractable footrest is extended, by the descent of the seat from the normal sitting position under the weight of the occupant and at the occupant's election, and in which all parts are restored to the sitting position by the occupant's forcible retraction of the footrest by flexing his knees.

11 Claims, 13 Drawing Figures

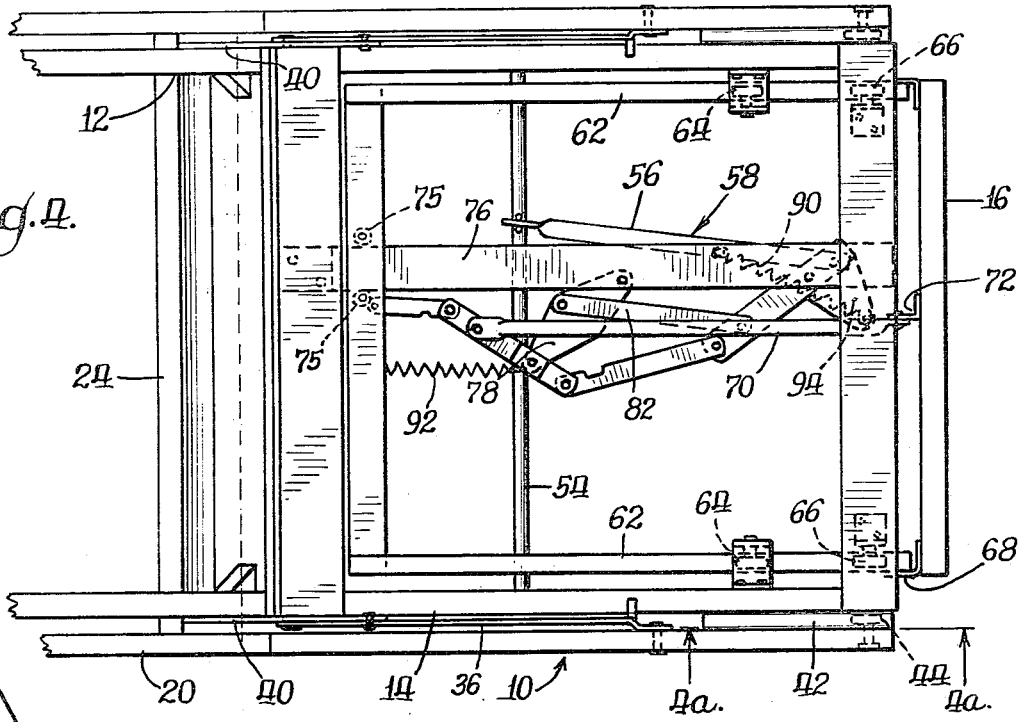
Fig. 4.
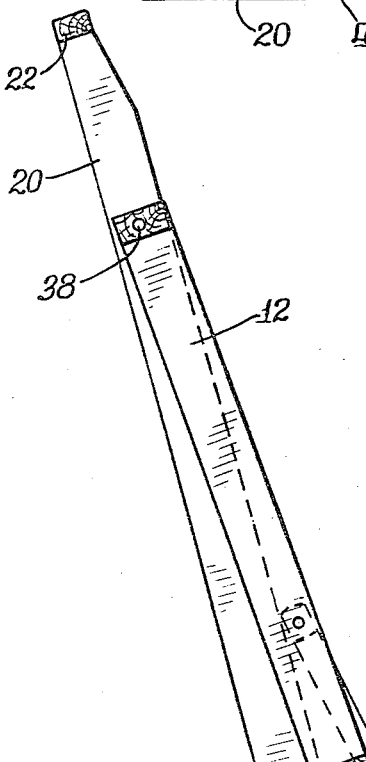
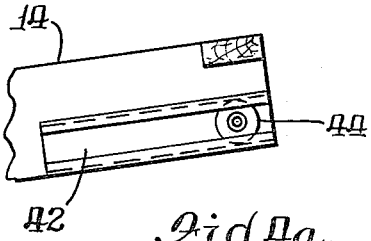
Fig. 4a.
Fig. 1.
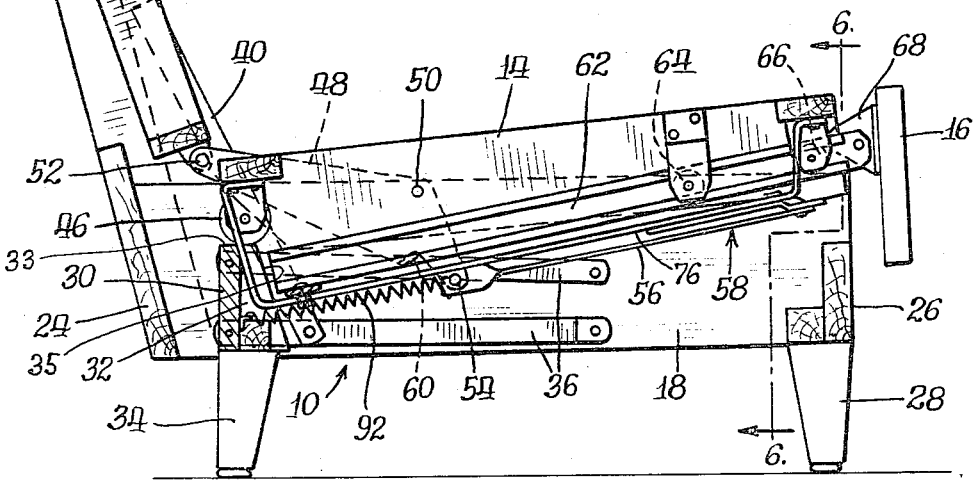

RECLINING CHAIR

This invention relates to reclining chairs.

In particular, it relates to a reclining chair having a relatively low backrest of proportion suitable to a non-reclining chair, a seat member, and a retractable footrest. In the upright sitting position, the chair is not visually identifiable as a reclining chair because of its low backrest, and because it does not have the rearwardly sloping parting line between the backrest and the chair arms which has characterized reclining chairs. In fact, the reclining chair of this invention may be constructed without arms and, furthermore, without the need for a side-mounted handle or lever to extend or retract the footrest. It may, as a result of these characteristics, be styled as a free-standing chair, with or without arms, or it may be incorporated at virtually any location into a conversational grouping of modular upholstered pieces.

The reclining chair of this invention associates the body-support members of the chair, i.e., the backrest and the seat member, with the footrest in such a way as to utilize the weight of the chair occupant to extend the footrest by the controlled descent of the rear end of the seat member in relation to the backrest. The descent of the seat to extend the footrest elevates the backrest, relatively, to provide support for the head of the occupant in the reclined position, and, conversely, the subsequent forcible retraction of the footrest by the substantial strength of the occupant's thigh muscles elevates the seat member relative to the backrest, restoring the chair to the original sitting position.

The practical result is to accomplish, in an upholstered chair of otherwise conventional proportions and styling, a reclining chair which does not suffer in comfort, having a backrest which is, in effect, magnified in height by the very operation of the chair mechanism, and which, notwithstanding the absence of any arms, may be shifted into a position of partial recline in order to extend the footrest. The chair may then be shifted into a position of further and complete recline with no effort on the part of the occupant except to place himself into an attitude of recline by thrusting the seat member farther forward while exerting pressure rearwardly with the shoulders against the backrest.

A detailed description of a chair in accordance with the invention is hereinafter made by reference to the accompanying drawings in which:

FIG. 1 is a cross-sectional, side elevational view of the framework of a chair of the invention, in the sitting position;

FIG. 4 is a plan view of the footrest extension linkage mounted beneath the seat in the sitting position corresponding to FIG. 1;

Figures 2, 5:
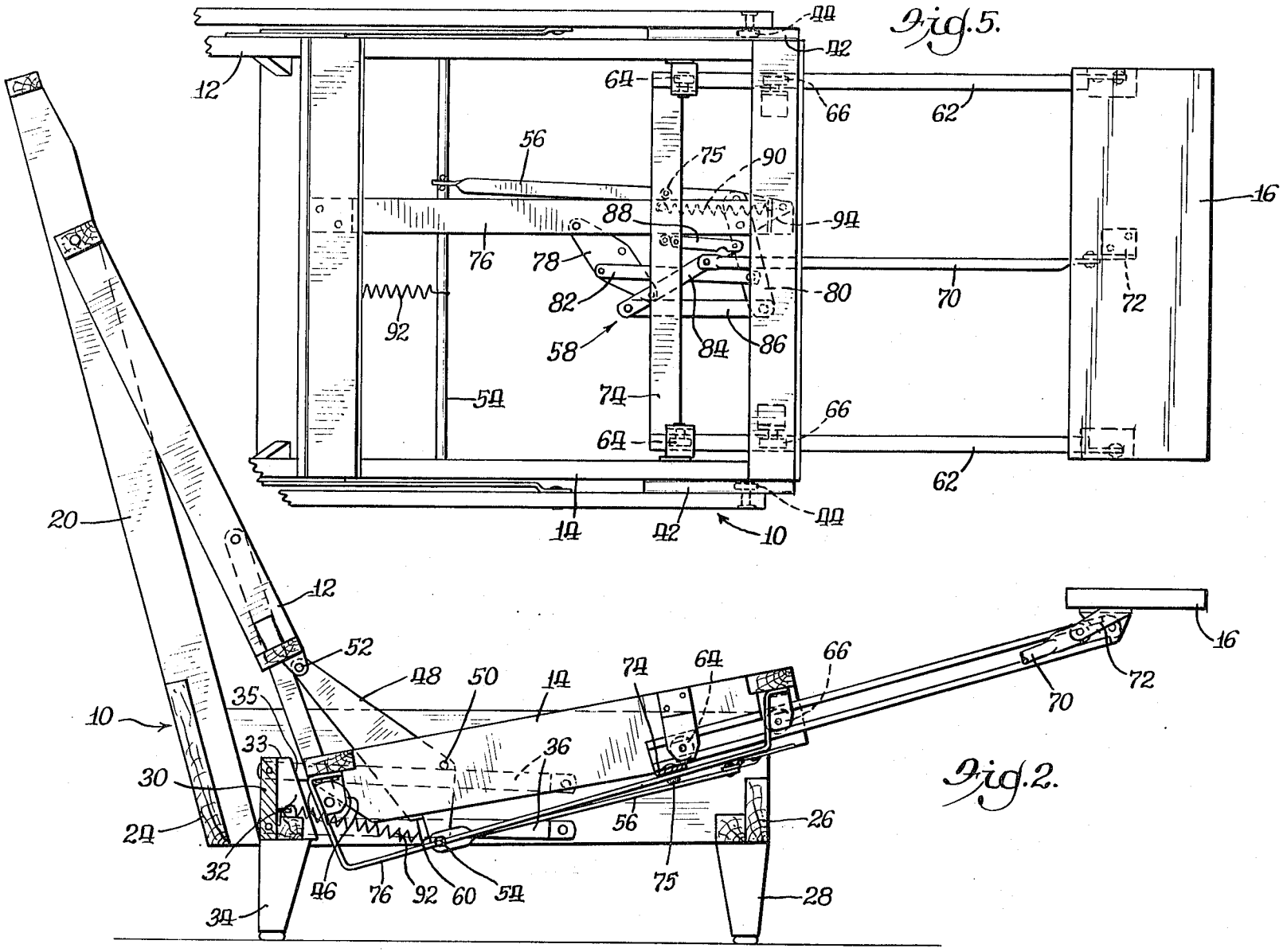
FIG. 2 is the same view of the chair in the intermediate or "inclined" position, i.e., with the seat member lowered with respect to the backrest, and with resulting extension of the footrest and the advancement of the lower end of the backrest relative to the seat member to increase the supporting pressure in the small of the occupant's back.
Figure 6:
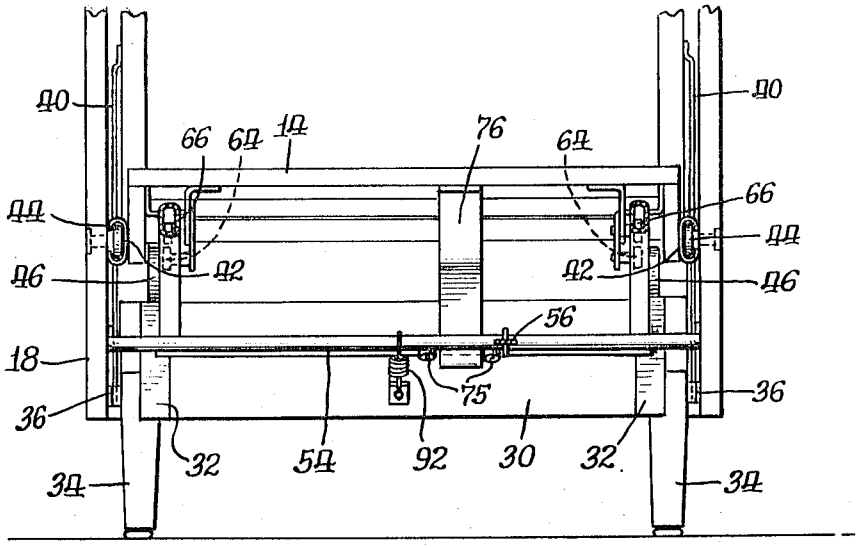
Figure 3:
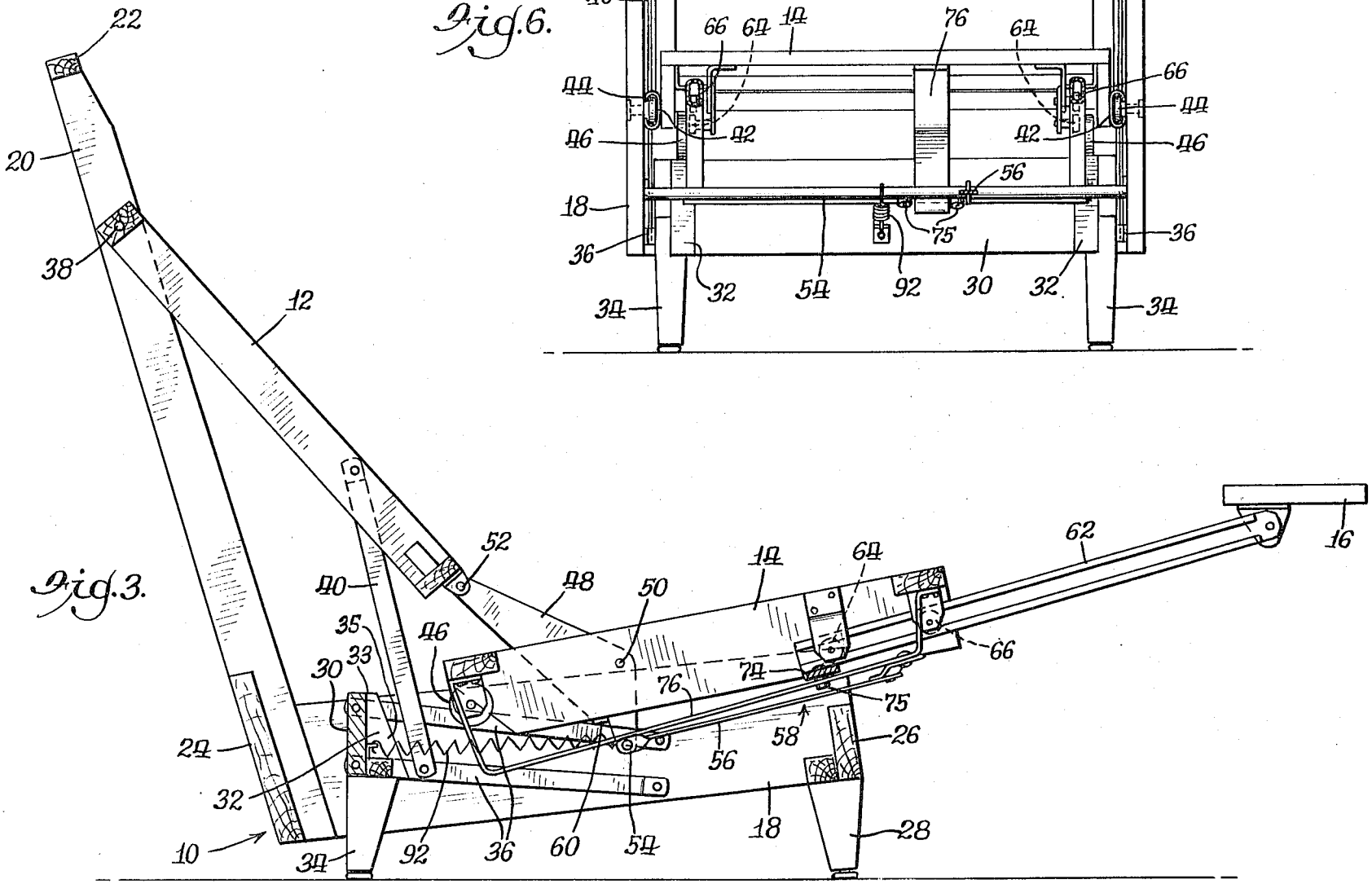
FIG. 3 is the same view of the chair in the fully reclined position, i.e., with the seat and lower end of the backrest moved still farther forwardly relative to the chair frame, and with a greater interior angle between the backrest and the seat member, the footrest remaining as fully extended as in the intermediate position, but with the chair frame as a whole tilted rearwardly.
Figure 7:
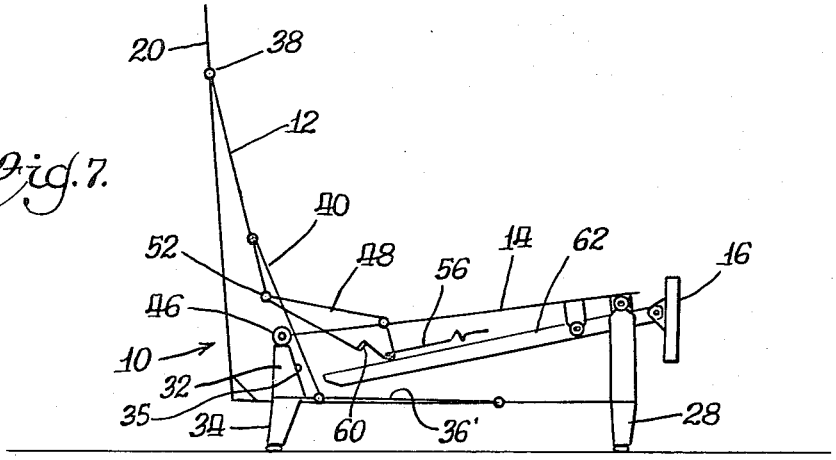
Figure 8:
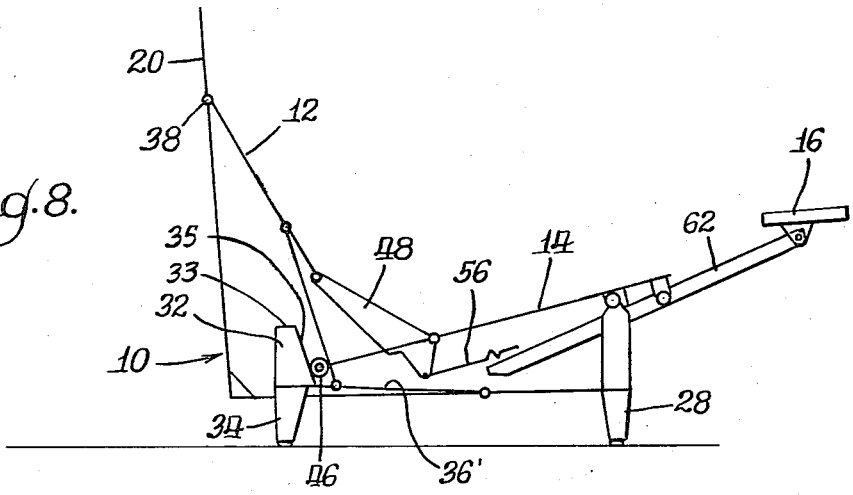
Figure 9:
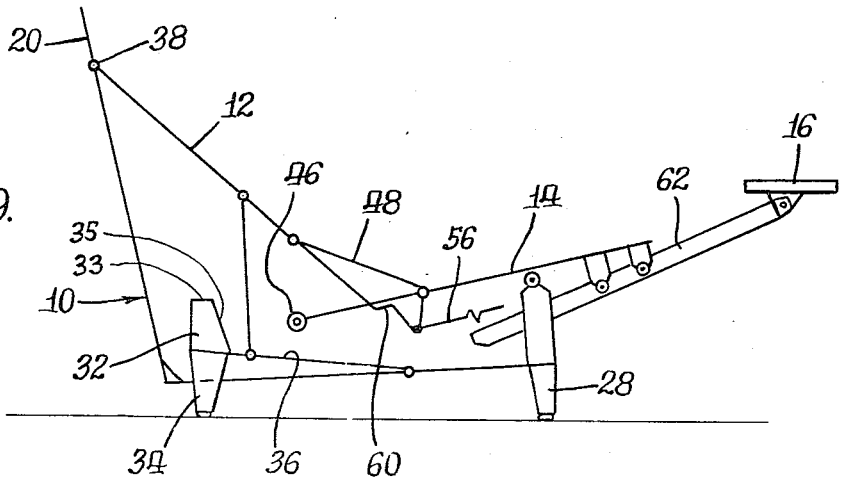
Figure 11:
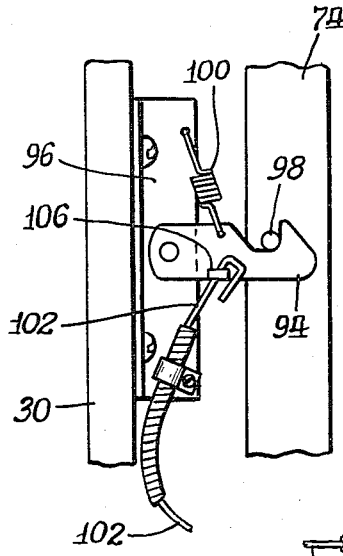
Figure 12:
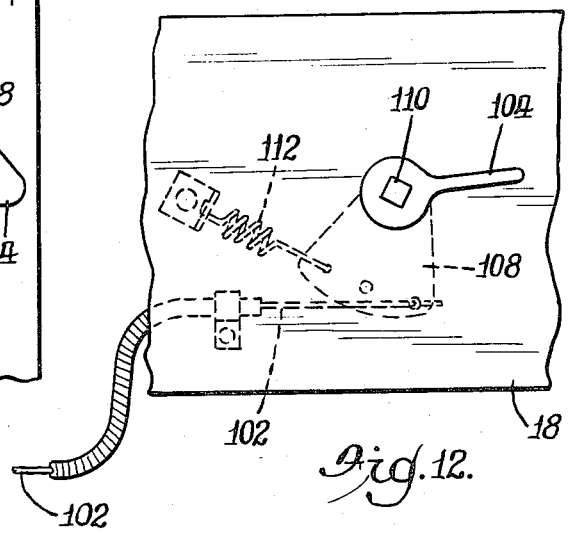
Figure 10:
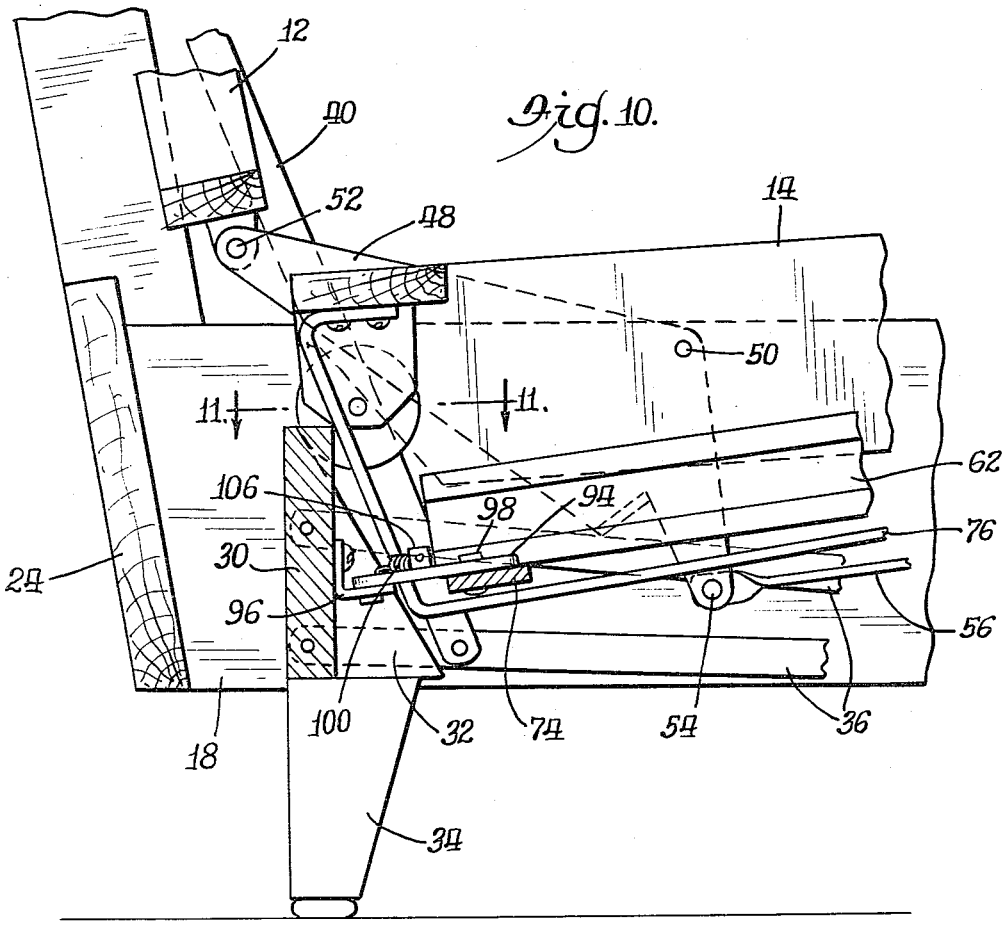

FIG. 4*a* is a fragmentary sectional elevation on line 4*a* of FIG. 4, showing the front mounting of the seat;

FIG. 5 is a plan view of the footrest extension linkage with the footrest extended, i.e., corresponding to FIG. 2;

FIG. 6 is a fragmentary sectional elevation taken on the line 6—6 of FIG. 1 to particularly show the roller mounting of the seat member on the chair frame at the front of the latter, as well as the roller mounting of the footrest supporting rails on the seat member of the chair;

FIGS. 7, 8, and 9 are simplified line diagrams of the chair linkage corresponding respectively to FIGS. 1, 2, and 3, from which the interrelation of the seat member, backrest, and chair frame may quickly be assimilated;

FIG. 10 is an enlarged fragmentary cross-sectional side elevational view of a modified form of chair of the invention;

FIG. 11 is a fragmentary plan view of a portion of the modified mechanism of FIG. 10, taken on the line 11—11 thereof; and FIG. 12 is a fragmentary side elevation of the chair frame showing, in association with FIGS. 10 and 11, the latch mechanism of the modified form.

GENERAL DESCRIPTION

The chair of the invention comprises an L-shaped normally stationary chair frame 10, which may be armless, a body-support comprising a backrest 12 pivotally suspended at or near its upper end from the chair frame 10, and a seat 14, which is movably connected to the lower end of the backrest and also movable forwardly and rearwardly in the chair frame 10. A retractable footrest 16 is underslung from the seat.

The movable connection of the seat to the backrest is such that when the seat is advanced from the sitting position (FIG. 1), the rear of the seat drops under the weight of the occupant of the chair, this stored energy being utilized, through linkage connection to the footrest 16 to extend the footrest out in front of the seat.

With the descent of the rear end of the seat and the extension of the footrest, the backrest 12 is, in effect, elongated, and its lower end is carried forwardly relative to the seat 14. This increase in the rearward slope of the backrest tends to increase, or at least to preserve, the angularity of the backrest to the seat in the sitting position while the assemblage of seat and backrest as a body-supporting unit is tilted somewhat rearwardly to an intermediate, partially reclined, or "inclined" position (FIG. 2).

From the intermediate position, i.e., with the rear end of the seat lowered and with the footrest extended, the chair may be increasingly reclined by further rearward pressure of the shoulders on the backrest and resulting forwardly thrusting reaction upon the seat, the footrest maintaining its extension (FIG. 3).

The occupant begins the return of the chair from the reclined position to the upright sitting position simply by first sitting up. This action eliminates the forward thrust of the body upon the seat, and permits the latter to return rearwardly by gravity into the intermediate position. Then, by flexing his knees to retract the footrest, the occupant raises the seat, and his own weight, to restore the chair to sitting position.

DETAILED DESCRIPTION

(a) The Chair Frame

In the illustrated preferred embodiment of the chair of the invention, the armless L-shaped chair frame 10 is built of wood and comprises a box-like base frame of relatively deep side members 18 with upright angled back members 20 joined together by a narrow cross member 22 at their tops to form the upstanding back portion of the chair frame. The two sides of the chair frame are joined at the back by a deep cross member 24 connected between the uprights of the back portion, and at the front by a relatively shallow cross member 26 which bridges the chair frame beneath the seat. At each front corner, the chair frame is provided with a leg 28 which raises the front of the chair above the floor. At its rear end, the chair frame 10 is actually supported by the backrest, whose load in turn is transferred to the floor by a rear leg structure comprising a wooden cross member 30 having secured at each of its ends a forwardly extending cam block 32 which together form a corner for the attachment of the rear chair legs 34.

The rear legs 34, their connecting cross member 30, and forwardly extending cam blocks 32 constitute a rear leg framework which is movably mounted on the chair frame 10 by means of a pair of forwardly extending links 36 upon which the rear leg structure is movable into the chair frame. The pivotal attachments of the two mounting links 36 to the side members 18 of the chair frame and to the rear leg structure, respectively, are not equidistant, i.e., the resulting four-bar linkage is not a parallelogram linkage, the purpose of the double-link mounting being to rotate the rear legs as the chair frame is lowered and raised, thus to maintain the front-to-rear distance between the points of contact of the legs with the floor as the rear leg structure moves into the chair frame, principally during the movement from the intermediate or "inclined" position (FIG. 2) to the position of full recline (FIG. 3), and vice versa. The manner and purpose of lowering the chair frame on the rear legs will subsequently be explained.

(b) The Body Support

The backrest 12 is a rectangular wooden frame which is pivotally suspended at its upper end from the uprights 20 of the back portion of the chair frame 10, as by headed pins 38 having bearing clearance in holes in the chair frame uprights 20 and a drive fit in aligned holes in the upper cap member of the backrest near its upper end. The backrest 12 is pivoted at each side to one of a pair of upstanding strut links 40, each of which in turn is pivoted at its lower end to one of the mounting links 36 of the rear leg framework of the chair. Each strut link 40 thus constitutes a toggle with the forwardly and rearwardly swingable backrest 12 and, with the backrest, supports the rear end of the chair frame 10 in all positions of the chair.

The seat 14 is likewise a rectangular wooden frame whose side members are placed on edge and whose front and rear cross members are laid flat and joined with the side members at notches in the latter to provide a flat upper perimeter for the seat frame.

At each side of the seat frame, extending longitudinally thereof along the lower outside edges of the side members at the front thereof, is a C-shaped metal channel 42 which is secured to the seat and receives between its curled flanges a roller 44 journalled upon the inwardly facing wall of the side member 18 of the chair frame 10, at the upper front corner of the same. The interfitted channels 42 and rollers 44 provide a pivotal mounting for the seat 14 at the front of the chair frame 10, as well as permitting fore-and-aft movement of the seat relative to the chair frame.

At its rear end, adjacent each rear corner of the seat frame, the seat 14 is provided with a supporting roller 46 journalled on a bracket secured to the underside of the rear cross member, and bearing upon the shelf-like upper surface 33 of the forwardly sloped cam block 32 at each side of the rear leg structure. In the normal sitting position of the chair (FIG. 1), the rear supporting rollers 46 are disposed directly above the upper surface of the cam blocks 32, either in direct load-transferring contact therewith, i.e., with the structure deflected under the weight of the occupant, or spaced slightly above the upper surface of the cam blocks 32 if the chair is unoccupied.

The backrest 12 and seat 14 of the chair are movably interconnected at each side of the chair by one of a pair of bell crank levers 48, each in the form of a triangular plate which is pivoted at 50 to the side member of the seat 14. In the sitting position (FIG. 1), the longer arm of the lever 48 extends rearwardly at a slight upward incline to a pivotal connection 52 with a bracket secured to the lower cap member of the backrest 12. The shorter arms of bell cranks 48 extend downwardly and slightly forwardly from their pivotal connections 50 to the seat, being cross-connected at their extremities by a torque tube 54 to assure movement of the two bell cranks 48 in unison. A drafting link 56 of the footrest extension linkage 58, still to be described, is pivoted to the torque tube 54.

Below its pivotal connection 50 to the seat, and slightly removed from the torque tube 54, each bell crank 48 has a shear-formed supporting tab or stop 60 which extends inwardly of the chair for contact with the underside of the side member of the seat 14 to limit the clockwise rotation of the bell crank lever 48 relative to the seat, as seen in FIGS. 2 or 3.

It will be appreciated, therefore, that when the seat 14 is moved forward from the position of FIG. 1, as by a forward thrust of the hips while pressing rearwardly with the shoulders against the backrest at its upper end, the rear supporting rollers 46 of the seat roll forwardly off the upper shelf surfaces 33 of the cam blocks 32, and the rear edge of the seat 14 descends under the weight of the occupant, moving slightly forward as well, as the rear supporting rollers 46 travel down the forward, sloping surfaces 35 of their associated cam blocks 32. As the seat 14 drops, having lost the support of the rear support rollers 46 upon the upper shelf surfaces 33 of the cam blocks 32, the bell crank lever 48 which connects the seat with the backrest rotates clockwise as seen in FIGS. 1 and 2 until the stop tab 60 thereof engages the underside of the side member of the seat.

The pivotal connection 52 of the bell crank to the backrest swings the latter forwardly about its upper pivotal connection 38 to the chair frame as the seat drops away from the backrest. As will be noted by comparing FIGS. 1 and 2, the descent of the rear end of the seat is substantial, resulting in an equivalent heightening of the backrest so that the upper end of the backrest provides ample support for the head of the occupant in subsequent further recline. At the same time, the descent of the seat advances the lower end of the backrest relative to the seat to intensify the supporting pressure of the lower end of the backrest against the small of the back of the occupant, i.e., the so-called "kidney support" which is important to the comfortable use of reclining chairs.

It may also be noted that when the limit of this movement is reached by the engagement of the stop tab 60 with the underside of the side member of the seat, and the bell crank lever 48 is thus immobilized relative to the seat, its pivotal connection 52 to the lower end of the backrest becomes, in effect, a direct pivotal connection of the backrest to the seat. Any further reclining movement of the chair, i.e., any further widening of the angle between the backrest and the seat, thereafter occurs only by virtue of relative rotation of the backrest and the seat about the bell crank pivots 52.

Before proceeding to the linkage for extending the footrest, it may be noted that the clockwise rotation of the bell crank lever 48 on the seat 14 occasioned by the descent of the back of the seat draws the shorter arm of the bell crank 48, and the drafting link 56, rearwardly relative to the seat. By linkage yet to be described, this action thrusts the footrest 16 forward on its supports to the fully extended position of FIG. 2.

Inasmuch as the entire rotation of the bell crank lever 48 occurs during the movement of the chair from the sitting position of FIG. 1 to the intermediate or "inclined" position of FIG. 2, there is no further extension of the footrest 16 relative to the seat during subsequent further reclining movement of the chair, i.e., from the FIG. 2 to the FIG. 3 position because, as earlier explained, the weight of the occupant effectively fixes the bell crank 48 to the seat 14.

Although not heretofore noted, the movement of the chair from the sitting position of FIG. 1 to the intermediate position of FIG. 2 carried the knee of the toggle formed by the backrest 12 and the strut link 40 forwardly over center as the lower end of the backrest 12 was drawn forwardly by the rotation of the bell crank 48. Thus, as the chair proceeds from the intermediate position of FIG. 2 to the fully reclined position of FIG. 3 by further forward movement of the seat, the lower end of the backrest is likewise carried farther forwardly relative to the chair frame, and the resulting further flexing of the toggle results in a rearward rotation of the chair frame 10 as a whole about the points of contact of its front legs with the floor.

The accompanying movement of the seat farther forwardly on the chair frame with a slight upward rotation tends to elevate the body of the occupant relative to the chair frame, but this is compensated by the lowering of the rear of the chair frame 10 relative to the rear legs 34 with the result that there is little, if any, change in the elevation of the center of gravity of that portion of the occupant's body reposed rearwardly of the roller fulcrum 44 supporting the seat 14 at the front of the chair frame. Moreover, as the forward movement of the seat from the intermediate position of FIG. 2 to the full recline depicted in FIG. 3 transfers more of the occupant's body weight forwardly of the fulcrum, the movement may be accomplished with relatively little physical exertion, and positions of recline intermediate those of FIGS. 2 and 3 may be maintained with little or no conscious effort by the occupant of the chair.

(c) The Footrest Mechanism

As earlier mentioned, one of the attractive features of the chair of the invention is the utilization of the weight of the occupant to extend the footrest, and the converse utilization of the occupant's forcible retraction of the footrest by the relatively powerful thigh muscles to jack up the rear of the seat to return the chair to the sitting position of FIG. 1. Within reason, any one of a number of known mechanisms for extending and retracting the footrest of a reclining chair would be applicable in the context of this invention, but I prefer the mechanism of my prior U.S. Pat. No. 3,869,169, the linkage of which I have modified slightly for substantially horizontal placement beneath the seat member of the chair.

The mounting of the footrest 16 is best seen by a comparison of FIG. 1 with FIG. 4, both showing the footrest retracted in the sitting position of the chair, and FIG. 2 with FIG. 5, both showing the footrest extended at the intermediate or "inclined" position of the chair, and from FIG. 6, which shows the mounting of the seat 14 on the chair frame 10 and the mounting of the footrest 16 on the seat.

The footrest 16 is pivotally mounted on the front ends of the two parallel rails 62, one at each side of the seat 14. The rails 62 are movable longitudinally of the seat at a slight forward and upward slope on a pair of support rollers 64 and 66 journalled on brackets secured to the seat frame near the front thereof. Each of the supporting rails 62 is a C-shaped channel, open inwardly, and each of the supporting rollers 64 and 66 is confined within the channel. As with the supporting rails of my prior U.S. Pat. No. 3,869,169, the two supporting rollers 64 and 66 resist the entire downward thrust of the weight of the occupant's legs on the footrest 16, the extension linkage 58 serving merely to move the footrest between the extended and retracted positions and to transmit the forces necessary to jack the seat member from the intermediate position of FIG. 2 to the sitting position of FIG. 1.

The footrest 16 is pivoted on the forward ends of its supporting rails 62 by a pair of mounting brackets 68 and is rotated rearwardly on those pivotal mountings by a draw bar 70 incident to its forward movement.

The draw bar 70 is a metal tube flattened at its front end for pivotal attachment to a horn-shaped bracket 72 secured to the back side of the footrest midway between the rails 62. The pivotal connection between the draw bar 70 and the bracket 72 is disposed above the pivot axes of the footrest mounting brackets so that a rearward pull on the draw bar incident to the extension of the footrest, all by means yet to be described, rotates the footrest through approximately 90° simultaneously with the extension of the footrest, the footrest proper being thereby rotated into an upwardly facing attitude to support the legs of the occupant.

At their rear ends, the two footrest support rails 62 are connected together by a cross bar 74 which is formed of steel strap. Underslung from the seat frame slightly off center thereof and sloping upwardly from back to front parallel with the footrest supporting rails 62 is a keel bar 76, also in the form of a heavy metal strap, the ends of which are suitably bent to provide mounting posts, which in turn are bent over at their extremities to provide attaching flanges for securing the keel bar to the seat 14 by screwing it to the front and rear cross pieces of the seat frame.

The keel bar 76 serves two important functions in the operation of the chair, namely, to provide a mounting site for the footrest extension linkage 58, and to constitute a guide rail to prevent the cocking or twisting of the rectangular frame comprised of the footrest 16, its two supporting rails 62, and their connecting cross bar 74. Two grooved rollers 75 journalled on posts extending downwardly from the cross bar 74 engage opposite side edges of the keel bar 76 to resist any side load which may be encountered, thus keeping the footrest supporting rails running true.

The footrest extension linkage per se, as earlier noted, is essentially that of my prior U.S. Pat. No. 3,869,169. Basically, it comprises two spaced and approximately parallel levers 78 and 80, each pivoted to the keel bar 76 for rotation in a plane parallel to that of the footrest rails 62. A connecting link 82 joins the two levers for rotation in unison, and the rearwardmost lever 78, at its extremity, is pivoted to a rock lever 84 which in turn is connected by a second link 86 to the forward lever 80 pivoted to the keel bar. The link 86 controls the throw of the rock lever 84, the opposite end of which is connected by a short drag link 88 to the cross bar 74.

The tubular draw bar 70 which controls the angularity of the footrest as an incident to its extension and retraction is also flattened at its rear end and pivoted to the rock lever 84 slightly inwardly of the attachment of the latter to the drag link 88. It will be appreciated, therefore, that as the two mounting levers 78 and 80 are swung forwardly, and the rock lever 84 is likewise swung forwardly at approximately twice the angular rate of rotation of the levers 78 and 80, the relative placement of the pivotal attachments of the rock lever 84 to the footrest draw bar 70 and to the drag link 88 produces a differential translation of those two pivots which rotates the footrest upwardly on its mounting brackets as the footrest is extended, and rotates it downwardly as the footrest is retracted.

To operate the extension linkage by the dropping of the seat member, and conversely to again elevate the seat member by the retraction of the footrest, the front mounting lever 78 of the footrest linkage is extended as a first-class lever beyond its mounting pivot and connected to the drafting link 56 which extends rearwardly beneath the keel bar 76. The drafting link 56 is made of steel strap which is punched near its rear end, twisted 90°, and journalled on the torque tube 54 which extends between and is welded to the downwardly extending shorter arms of the two bell crank levers 48. The torque tube 54 assures the movement of the bell cranks in unison to prevent racking of the seat member and backrest. The drafting link 56 is positioned laterally of the torque bar by any suitable stop members, e.g., a pair of flanking drive pins or spots of weld metal.

OPERATION OF THE CHAIR

The major components of the chair are reproduced diagrammatically in FIGS. 7, 8, and 9, which correspond respectively to FIGS. 1, 2, and 3, with the exception that the legrest extension linkage, which would be disposed edgewise in the diagrams, is not shown, and the rear leg structure is shown mounted on the chair frame by a single link 36' instead of the double link arrangement of the preferred embodiment. Indeed, I first prototyped the chair with the rear leg mounting in the single link form and provided a small wheel at the bottom of each rear leg to accommodate the change of distance between the front and rear legs occasioned by the retraction movement, which also makes the chair more readily movable for furniture rearrangement and cleaning.

To recapitulate the operation of the chair mechanism by reference to the diagrams of FIGS. 7 to 9 inclusive, the occupant of the chair, by a slight forward thrusting motion of the hips while exerting pressure with the shoulders against the backrest 12, moves the seat 14 forwardly until the rear, shelf rollers 46 move off the upper supporting surface of the cam blocks 32 and descend along the forwardly sloped surfaces thereof.

The descent of the seat 14 away from the backrest 12 rotates the two bell cranks 48 in unison until the downward movement of the rear end of the seat is arrested by the engagement of the bell crank stops 60 with the underside of the seat frame. The rotation of the bell crank members 48, as will be apparent by comparison of FIGS. 7 and 8, has shifted the lower end of the backrest 12 forward relative to the chair frame 10, but more importantly, forward also relative to the seat 14 to provide supporting pressure, as earlier noted, into the small of the occupant's back.

The same rotation of the bell crank 48 has swung the downwardly extending arms thereof rearward relative to the seat 14, hauling the drafting link 56 to extend the footrest 16.

With the footrest 16 extended, i.e., with the intermediate position of FIG. 8 attained, the occupant need only lean farther back, which thrusts the seat 14 still farther forward, further opening the angle between the backrest and the seat by relative rotation between the two about the attachments of the bell cranks 48 to the backrest. The resulting further flexure of the backrest and its supporting toggle link 40 causes the chair frame as a whole to sink rearwardly about the line of contact of its front legs with the floor, which, as earlier noted, provides offsetting compensation for the elevation of the center of gravity of the occupant's body resulting from the further elevation of the seat by its forward motion on the chair frame. At the same time, the forward movement of the seat 14 shifts the weight distribution of the occupant's body relative to the fulcrum support of the front of the seat, increasing the moment of the body weight forward of the fulcrum. The two effects combine to permit the movement of the chair into recline (FIG. 9) with a minimum of effort by the occupant.

Upon forward movement of the upper body from the fully reclined position of FIG. 9, as though to sit up, the weight of the occupant upon the seat returns the seat to the FIG. 8 position, swinging the lower end of the backrest rearwardly relative to the chair frame and elevating the chair frame as the backrest 12 and toggle links 40 come more nearly into line at the intermediate position.

To return to the sitting position from the intermediate position, the occupant simply retracts the footrest by flexing his knees. The retraction of the footrest hauls the drafting link 56 forwardly, which rotates the bell cranks 48 counter-clockwise as viewed in FIGS. 7 and 8. This in turn elevates the rear end of the seat and allows the seat to retract further to place the supporting rollers 46 upon the top surfaces of the cam blocks 32.

(d) OPTIONAL SPRINGS

While the illustrated chair as heretofore described operates satisfactorily without the use of springs, I have found it useful from the standpoint of maintaining the appearance of the chair to add an overcenter spring 90 to the footrest extension linkage to maintain the footrest snugly closed in the sitting position, and to provide a reinforcing spring 92 to maintain the chair snugly in the sitting position, and to maintain as well the full extension of the footrest when the chair is positioned for full recline.

The overcenter spring 90 of the footrest linkage is a tension spring connected to a sidewardly extending arm 94 of the forward footrest extension lever 80 and to a suitable anchor post on the keel strap 76. A comparison of FIGS. 4 and 5 shows that the spring 90 is tensioned in both positions, i.e., with the footrest fully extended and fully retracted. The overcenter spring 90 serves to maintain the dress of the chair in the closed position, notwithstanding clearances or wear in the several pivots of the extension linkage, and provides sufficient load in the sitting position to overcome the tendency of the seat deflection under load to effect a slight extension of the footrest.

The reinforcing spring 92 is connected between the torque tube 54 and the cross member 30 of the rear leg structure. It serves two functions, one of which is readily apparent by a comparison of FIGS. 2 and 3, namely, to maintain the footrest firmly extended in the fully reclined position. That is to say, as the spring 92 is stretched by the forward movement of the seat from the intermediate position of FIG. 2 to the fully reclined position of FIG. 3, the rearward draw of the spring on the torque tube 54 maintains the extension of the footrest against incidental forces tending to retract it.

The second function of the reinforcing spring 92 is less apparent, but will be understood by comparison of FIGS. 1 and 2, in which the spring is stretched approximately equally.

When the footrest is retracted (FIG. 2 to FIG. 1), the torque tube 54 joining the lower arms of the bell cranks 48 is drawn forward, or counter-clockwise in FIGS. 1 and 2, stretching the spring 92. While this lifts the seat 14 relative to the backrest 12 and chair frame 10, it also tensions the spring 92, providing an additional and positive rearward force to supplement the rearward component of the occupant's weight on the seat.

Conversely, when the chair is in the sitting position (FIG. 1), any forward movement of the seat 14 therefrom is increasingly resisted by the spring 92, until the rear support rollers 46 of the seat 41 roll off the tops of the cam blocks 32 and the weight of the occupant carries the seat 14 down the forward slopes of the cam blocks 32 to the intermediate position of FIG. 2. The reinforcing spring 92, in that capacity, therefore, serves to maintain the dress of the upholstered chair by maintaining the seat and backrest snugly rearward in the FIG. 1 sitting position.

As earlier noted, however, the springs 90 and 92 are optional, providing additional resistance to the retraction of the footrest by incidental rearward forces exerted only casually thereon, and essentially maintaining the cosmetic appearance of the chair by resisting the tendency of mere load deflection in sitting position to advance the footrest out of fully retracted position.

THE MODIFICATION OF FIGS. 10–12 INCLUSIVE

In the modified form of FIGS. 10–12 inclusive, the shelf at the top of the cam blocks 32 is eliminated, but the chair linkage is releasably latched in the sitting position instead. With the release of the latch, the occupant's weight is immediately effective to move the chair from the sitting position depicted in FIG. 10 (corresponding to FIG. 1) to the intermediate position depicted by FIG. 2, i.e., with footrest extended.

Specifically, and referring to FIG. 10, the cam block 32 of the modified form is reshaped to eliminate the upper shelf, and the forwardly and downwardly sloped front surface of the cam block is tangent to the roller 46 in the sitting position. Without more, the weight of an occupant upon the seat 14 would cause the seat to descend, rotating the lever 48 to draw the lower end of the backrest forward and to haul rearwardly upon the drafting link 56 to extend the footrest, i.e., to haul the cross bar 74 forwardly, thus to project the supporting rails 62 at whose forward ends the footrest 16 is carried. The releasable latch provided to prevent the extension of the footrest, except at the will of the occupant, is mounted on the chair frame and arranged to engage, and to prevent the forward movement of, the cross bar 74.

The latch proper comprises a hook 94 which is formed of flat bar stock and pivoted to an angle bracket 96 secured to the cross member 30 of the rear leg structure. The hook is positioned to engage and confine a cooperating latch pin 98 protruding upwardly from the cross bar 74. A tension spring 100 stretched between the hook and its mounting bracket 96 normally maintains the engagement of the hook with the pin to prevent the extension of the footrest, and thus, indirectly through the footrest operating linkage 58 and the lever 48, to prevent the descent of the seat 14 under the occupant's weight.

For the release of the latch, there is provided a Bowden wire 102 which extends between the latch hook 94 and an operating lever 104 which may be located at any point of the chair frame conveniently accessible to the occupant and is shown in FIG. 12, in the context of an armless chair, as mounted on the side rail 18 of the chair frame.

At the latch end, the Bowden wire 102 is passed through a hole in an upstanding tab 106 secured to the latch hook, and the wire is bent back on itself to provide a lost-motion connection so that the latch hook may be cammed sidewardly upon the return of the cross bar 74 and upstanding latch pin 98 to the fully rearward position when the footrest is forcibly retracted by the occupant. The sheath of the wire 102 is anchored to the mounting bracket 96 by a suitable clip.

At its other end, the Bowden wire 102 is bent sidewardly and then forwardly and inserted into a hole in a lever segment 108 which is located inside of the side member 18 of the chair frame and secured to a short shaft 110 journalled in the side member 18 with its outer end secured to the operating lever 104. The sheath of the Bowden wire is similarly anchored to the inside face of the side member 18 of the chair frame, and a small spring 112 provided to return the segment, lever, and Bowden wire to the illustrated position after the latch is operated.

Upon the return of the chair to the sitting position of FIG. 10 by the forcible retraction of the footrest 16, the seat 14 is elevated by the counter-clockwise rotation of the lever 48 and the cross member 74 and latch pin 98 thereon engage the cam-shaped nose of the latch hook 94, forcing it sidewardly to subsequently reseat itself about the latch pin by the force of the latch spring 100.

In overall function, the modified form of FIGS. 10 to 12 is the same as that of FIGS. 1 to 9, the sole difference residing in that initial action required to render the occupant's weight effective to place the chair into the intermediate position of recline, viz., a slight forward thrust on the seat in the form of FIGS. 1 to 9, and the release of the latch in the form of FIGS. 10 to 12. Both forms are restored securely to the sitting position by the occupant's forcible retraction of the footrest, without more.

The features of the invention believed new and patentable are set forth in the appended claims.

What is claimed is:

1. A reclining chair having a normally stationary chair frame with an upstanding back portion, a backrest pivotally suspended from the back portion of the chair frame for forward swinging movement of the lower end of the backrest from a sitting position to a reclining position, and vice versa, and a seat member movably connected to the lower end of the backrest, and slidably and pivotally supported by the chair frame near the front of the chair frame;

the improvement wherein the chair is also provided with a retractable footrest movable from a stowed position beneath the seat member to an extended position forwardly thereof to support the legs of the occupant, and a drive linkage beneath the seat member to extend and retract the footrest when actuated;

the movable connection between the seat member and backrest comprises a lever which is pivoted to both of them and connected to said drive linkage, and is oriented in said sitting position to utilize the weight of the occupant to cause the rear end of the seat member to descend and thereby to advance the lower end of the backrest relative to the seat member and to actuate the drive linkage to extend the footrest, the rear end of said seat member being conversely raisable by the forcible retraction of the footrest; and means capable of being disabled by the occupant is provided to prevent the descent of the rear end of the seat member from the sitting position.

2. The improvement of claim 1 wherein the lever extends rearwardly and upwardly from the seat member to the backrest in said sitting position and is provided with a stop engageable with one of the seat member and backrest to limit the drop of the seat, further forward movement of the seat resulting in further recline of the backrest relative to the seat about the pivotal connection of the lever to the other one of said seat member and backrest.

3. The improvement of claim 1 wherein said means provided to prevent the descent of the rear end of the seat member from the sitting position is a shelf member on the chair frame positioned for the direct transfer of load from the seat member to the shelf when the chair is in the sitting position, and from which the seat member is disengageable by the occupant by thrusting the seat forward with concommitant rearward pressure of the shoulders upon the backrest.

4. The improvement of claim 3 wherein the shelf member has an extended downwardly and forwardly sloped surface, and the transfer of load from the seat member to said shelf member is made by a roller journalled on the back of the seat member and engageable with said shelf member.

5. The improvement of claim 2 in accordance with claim 4 wherein the lever pivoted to the backrest and seat member and connected to the drive linkage extends downwardly from its pivotal connection to the seat member to its connection to the footrest drive linkage and actuates said drive linkage to extend the footrest by hauling rearwardly on said drive linkage when the seat member descends, and the forcible retraction of the footrest causes said drive linkage to haul forwardly on said lever to elevate the seat and retract the lower end of the backrest, and wherein a spring is connected between the chair frame and the downward extension of said lever so as to be loaded by said further forward movement of the seat to maintain the footrest firmly extended.

6. The improvement of claim 1 wherein the chair frame is supported above the floor by means including a rear leg structure movably mounted on the chair frame to raise and lower the back of the chair frame to alter the pitch of the frame, and the backrest is connected to the rear leg structure to lower the back of the chair frame as the lower end of the backrest moves forward.

7. The improvement of claim 6 wherein the rear leg structure is movable upwardly into the chair frame and the connection thereof to the backrest comprises a link connection between them, said link connection and backrest constituting a toggle between the rear leg structure and the upstanding back portion of the chair frame.

8. The improvement of claim 1 wherein the chair frame is supported above the floor by means including a rear leg structure movably mounted on the chair frame for movement into the frame to tilt the chair frame rearwardly, and a link connecting the rear leg structure to the backrest in a forwardly-breaking toggle between the rear leg structure and the upstanding back portion of the chair whereby the forward and upward movement of the lower end of the backrest and the rear end of the seat occasioned by forward movement of the seat into the reclining position is accompanied by the lowering of the back portion of the chair frame.

9. In a reclining chair having a normally stationary chair frame, and a body support including a seat and a backrest movably mounted on the chair frame for movement between a sitting position and a reclining position;

the inclusion by said chair frame of a rear leg structure movably mounted on the chair frame to raise and lower the back of the chair frame to alter the pitch of the chair frame, and a connection between the body support and the rear leg structure activated by the movement of the body support toward the reclining position on the chair frame to lower the back of the chair frame, and activated by reverse movement of the body support into the sitting position thereon to raise the back of the chair frame.

10. The mechanisms of claim 9 wherein the chair is also provided with a retractable footrest movable from a stowed position beneath the seat to an extended position forwardly thereof to support the legs of the occupant, and a driving connection between the footrest and body support for extending the footrest by movement of the body support toward the reclining position and for righting the body support and raising the back of the chair frame by the retraction of the footrest into the stowed position.

11. The improvement of claim 1 wherein said means provided to prevent the descent of the rear end of the seat member comprises inter-engageable latch means between two elements of the chair which experience relative movement upon the descent of the rear end of the seat, and means operable by the occupant is provided to release said latch means.

* * * * *